US012735883B2

(12) United States Patent
Lin et al.

(10) Patent No.: US 12,735,883 B2
(45) Date of Patent: Sep. 15, 2026

(54) TOILET SEAT BODY AND TOILET

(71) Applicant: Quanzhou Komoo Intelligent Kitchen & Bath Co., Ltd, Quanzhou (CN)

(72) Inventors: Xiaofa Lin, Quanzhou (CN); Xiaoshan Lin, Quanzhou (CN); Shan Lin, Quanzhou (CN); Yanxin Xu, Quanzhou (CN); Rongrong Xu, Quanzhou (CN)

(73) Assignee: Quanzhou Komoo Intelligent Kitchen & Bath Co., Ltd., Quanzhou (CN)

( * ) Notice: Subject to any disclaimer, the term of this patent is extended or adjusted under 35 U.S.C. 154(b) by 170 days.

(21) Appl. No.: 18/832,920

(22) PCT Filed: Dec. 19, 2022

(86) PCT No.: PCT/CN2022/140115
§ 371 (c)(1),
(2) Date: Jul. 24, 2024

(87) PCT Pub. No.: WO2024/031909
PCT Pub. Date: Feb. 15, 2024

(65) Prior Publication Data

US 2025/0154757 A1 May 15, 2025

(30) Foreign Application Priority Data

Aug. 12, 2022 (CN) ..... 202222129473.4

(51) Int. Cl.
*E03D 11/06* (2006.01)

(52) U.S. Cl.
CPC ..... *E03D 11/06* (2013.01)

(58) Field of Classification Search
CPC ..... E03D 11/06; E03D 11/08; E03D 11/13
See application file for complete search history.

(56) References Cited

U.S. PATENT DOCUMENTS 6,145,138 A * 11/2000 Nakamura ..... E03D 11/02 4/420
2012/0210505 A1 8/2012 Pearson
(Continued)

FOREIGN PATENT DOCUMENTS

CN 101835945 A 9/2010
CN 104854283 A 8/2015
(Continued)

OTHER PUBLICATIONS

Extended European Search Report for 22954847.4 Mailed Apr. 3, 2025.
(Continued)

*Primary Examiner* — Christine J Skubinna
(74) *Attorney, Agent, or Firm* — Foley & Lardner LLP

(57) ABSTRACT

A toilet seat body and a toilet are provided. The toilet seat body (1) is provided with a bowl (10). The bowl (10) comprises a water inlet part (101), a flow guide part (102) and a sewage discharge part (103) which are successively connected, the water inlet part (101) being provided with rim holes, and the sewage discharge part (103) being provided with a sewage outlet. The water inlet part (101) is arranged at the top of the bowl (10), the water inlet part (101) being at least partially formed as a rim-free area (101A), and the rim-free area (101A) being smoothly connected to the flow guide part (102).

14 Claims, 3 Drawing Sheets

(56) References Cited

U.S. PATENT DOCUMENTS

| | | | | |
|---|---|---|---|---|
| 2013/0219605 | A1 | 8/2013 | Grover et al. | |
| 2019/0153713 | A1* | 5/2019 | Derksen | E03D 11/02 |
| 2020/0277775 | A1* | 9/2020 | Halloran | B05B 15/654 |
| 2020/0284016 | A1* | 9/2020 | Stammel | E03D 11/13 |
| 2021/0198882 | A1* | 7/2021 | Yang | E03D 9/032 |

FOREIGN PATENT DOCUMENTS

| | | | | |
|---|---|---|---|---|
| CN | 105986614 | A | 10/2016 | |
| CN | 206916880 | U | 1/2018 | |
| CN | 108560666 | A | 9/2018 | |
| CN | 209837222 | U | 12/2019 | |
| CN | 210507673 | U | 5/2020 | |
| CN | 211922885 | U | 11/2020 | |
| CN | 112177126 | A | 1/2021 | |
| CN | 216142127 | U | 3/2022 | |
| CN | 114411909 | A | 4/2022 | |
| CN | 114508158 | A | 5/2022 | |
| EP | 3444408 | A1 * | 2/2019 | E03D 1/38 |
| EP | 3444408 | B1 | 11/2020 | |
| EP | 4033043 | A1 | 7/2022 | |
| GB | 2431937 | A | 5/2007 | |
| JP | 2004011414 | A | 1/2004 | |
| JP | 2016148218 | A | 8/2016 | |
| JP | 2020026680 | A | 2/2020 | |

OTHER PUBLICATIONS

Office Action dated Aug. 8, 2025 for KR10-2024-7026273 and English Translation.

Office Action dated Jul. 22, 2025 for JP2024-541804 and English Translation.

International Search Report for PCT/CN2022/140115 Mailed Apr. 18, 2023.

* cited by examiner

TOILET SEAT BODY AND TOILET

CROSS-REFERENCE TO RELATED APPLICATIONS

The present application is a U.S. National Phase Entry of International Application No. PCT/CN2022/140115 having an international filing date of Dec. 19, 2022, which claims priority of Chinese Patent Application No. 202222129473.4, filed to the CNIPA on Aug. 12, 2022 and entitled "Toilet Seat Body and Toilet". Contents of the above-identified applications should be regarded as being incorporated herein by reference.

TECHNICAL FIELD

The present application relates to, but is not limited to, the field of toilet technologies, and particularly relates to a toilet seat body and a toilet.

BACKGROUND

At present, most of the upper ends of relevant toilet seat bodies on the market or which have been disclosed are rimmed, and the rimmed areas are used to arrange brush ring water outlets and the like therein. An overall structure of a toilet seat body is complex, and it is easy to hide dirt in a rimmed area, and it is difficult for users to clean it thoroughly during the cleaning process, which may easily lead to the growth of bacteria and affect human health.

SUMMARY

The following is a summary of the subject matter described in detail herein. This summary is not intended to limit the protection scope of the claims.

An embodiment of the present disclosure provides a toilet seat body provided with a bowl cavity. The bowl cavity includes a water inlet part, a flow guide part, and a sewage discharge part connected sequentially. The water inlet part is provided with a brush ring water outlet and the sewage discharge part is provided with a sewage discharge port. The water inlet part is located at a top part of the bowl cavity, the water inlet part is at least partially configured as a rimless area, and the rimless area is smoothly connected with the flow guide part.

An embodiment of the present disclosure provides a toilet, comprising the toilet seat body according to any of the above embodiments and a brush ring assembly installed to the brush ring water outlet.

Other aspects will become apparent after reading and understanding the drawings and detailed description.

BRIEF DESCRIPTION OF DRAWINGS

The drawings are used for providing a further understanding of technical solutions of the present disclosure, and constitute a part of the specification. They are used together with embodiments of the present application to explain the technical solutions of the present disclosure, and do not constitute a restriction on the technical solutions of the present disclosure.

REFERENCE SIGNS

1—toilet seat body; 2—brush ring assembly; 3—sewage discharge box assembly, 30—sewage discharge pipe, 31—connection element;

10—bowl cavity; 11—installation cavity;

101—water inlet part, 101A—rimless area, 101B—rimmed area;

102—flow guide part, 103—sewage discharge part, 104—sewage discharge port, 105—brush ring water outlet, 106—extension part, 106*a*—first extension region, 106*b*—second extension region, 106*c*—notch, 107—recess part, 107*a*—first recess, 107*b*—second recess, 108—smooth part.

DETAILED DESCRIPTION

The technical solutions of the present disclosure will be further described below in conjunction with the accompanying drawings and through implementations. It can be understood that the embodiments described herein are only intended to explain the present disclosure and do not limit the present disclosure.

Figure 1:
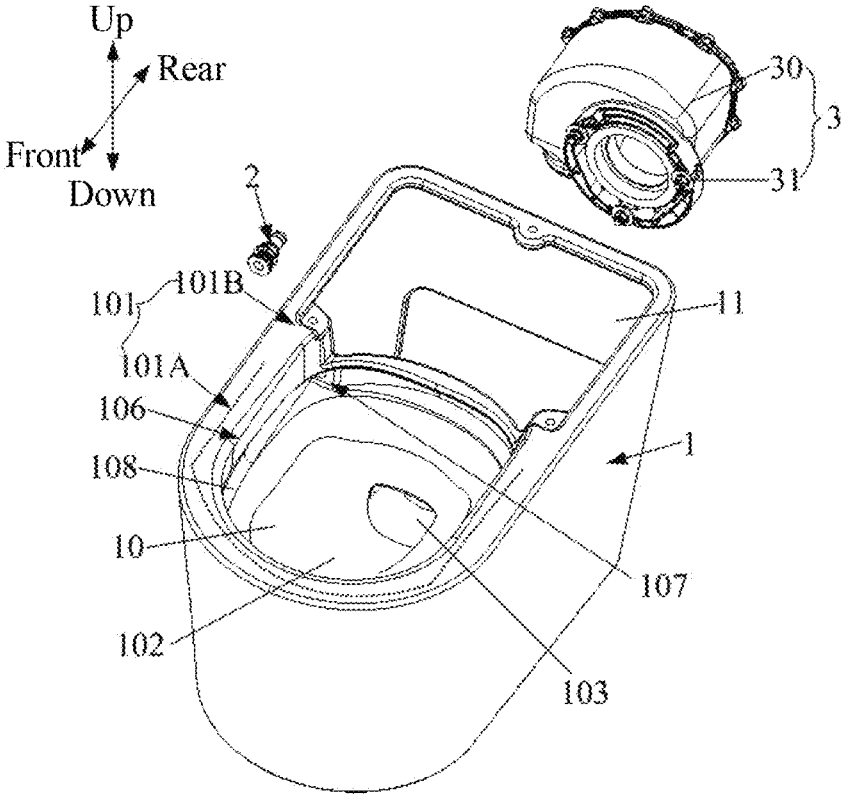
FIG. 1 is an exploded schematic view of a toilet according to some schematic embodiments of the present application.

In an embodiment of the present application, as shown in FIGS. 1 to 6, a toilet is provided. As shown in FIG. 1, the toilet includes a toilet seat body 1 and a brush ring assembly 2. The brush ring assembly 2 is installed on the toilet seat body 1, and the installation method may be chose as screwing or the like. The brush ring assembly 2 is used for conveying brush ring liquid into a bowl cavity 10 of the toilet seat body 1. The bowl cavity 10 may be approximately in a shape of an inverted frustum as a whole. The brush ring liquid may be tap water, or a mixture of tap water and disinfectant, and the like. The toilet seat body 1 may be made of ceramic material and manufactured by a process such as slip casting, or may be made of plastic or the like.

Figure 2:
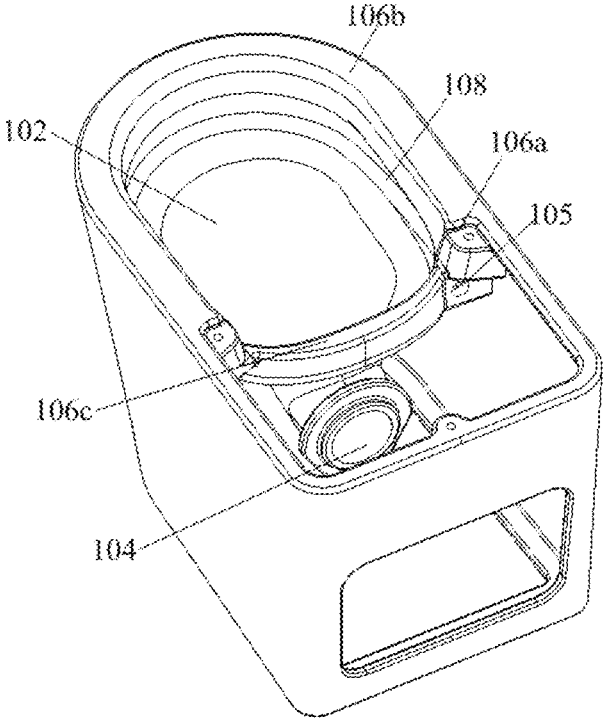
FIG. 2 is a first axonometric schematic diagram of a toilet seat body according to some schematic embodiments of the present application.

As shown in FIG. 1, the bowl cavity 10 includes a water inlet part 101, a flow guide part 102, and a sewage discharge part 103 connected sequentially. The water inlet part 101 and the flow guide part 102 may be arranged in an upper and lower direction, and the water inlet part 101 may be located at the top of an entire bowl cavity 10. One end of the sewage discharge part 103 is communicated with the flow guide part 102, and the other end of the sewage discharge part 103 may extend toward a rear side of the toilet seat body 1. As shown in FIG. 2, the sewage discharge part 103 is provided with a sewage discharge port 104, and the sewage discharge port 104 may be provided at an end face of an extension end of the sewage discharge part 103. A shape of the flow section of the sewage discharge port 104 may be provided as a circle or the like. As shown in FIG. 2, the water inlet part 101 is provided with a brush ring water outlet 105, and the brush ring assembly 2 may be installed on the toilet seat body 1 through the brush ring water outlet 105. The brush ring water outlet 105 may be provided on a rear side of the bowl cavity 10, so as not to affect the appearance aesthetics of the entire toilet seat body 1.

Part or all of the water inlet part 101 may be configured as a rimless area, and the rimless area may be smoothly connected with the flow guide part 102 located below. As shown in FIGS. 1 to 4, a case in which a part of the water inlet part 101 is configured as a rimless area is taken as an example. As shown in FIG. 1, the water inlet part 101 includes a rimless area 101A (as shown in FIG. 1, illustrated by a dashed line) and a rimmed area 101B. By designing the rimless area 101A and the smooth connection between the rimless area 101A and the flow guide part 102, it may effectively avoid the accumulation of dirt at the top of the bowl cavity 10, and is easy to clean and operate, which is beneficial to human health and may also improve the user experience.

Figure 3:
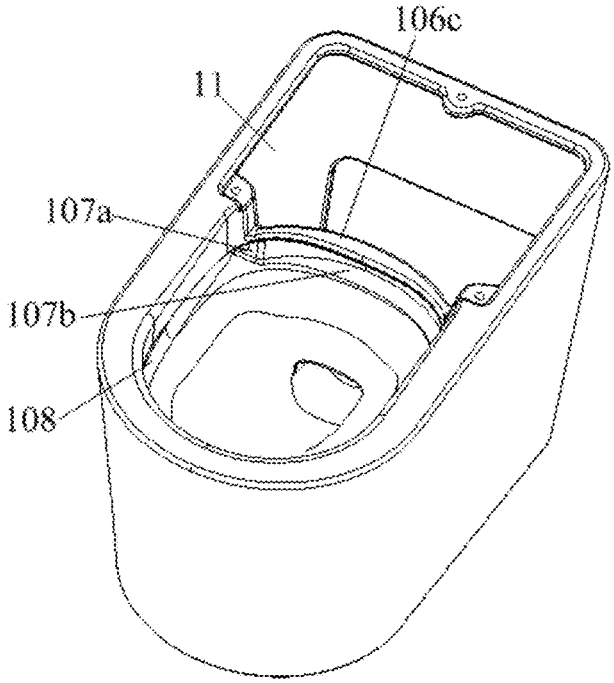
FIG. 3 is a second axonometric schematic diagram of a toilet seat body according to some schematic embodiments of the present application.
Figure 4:
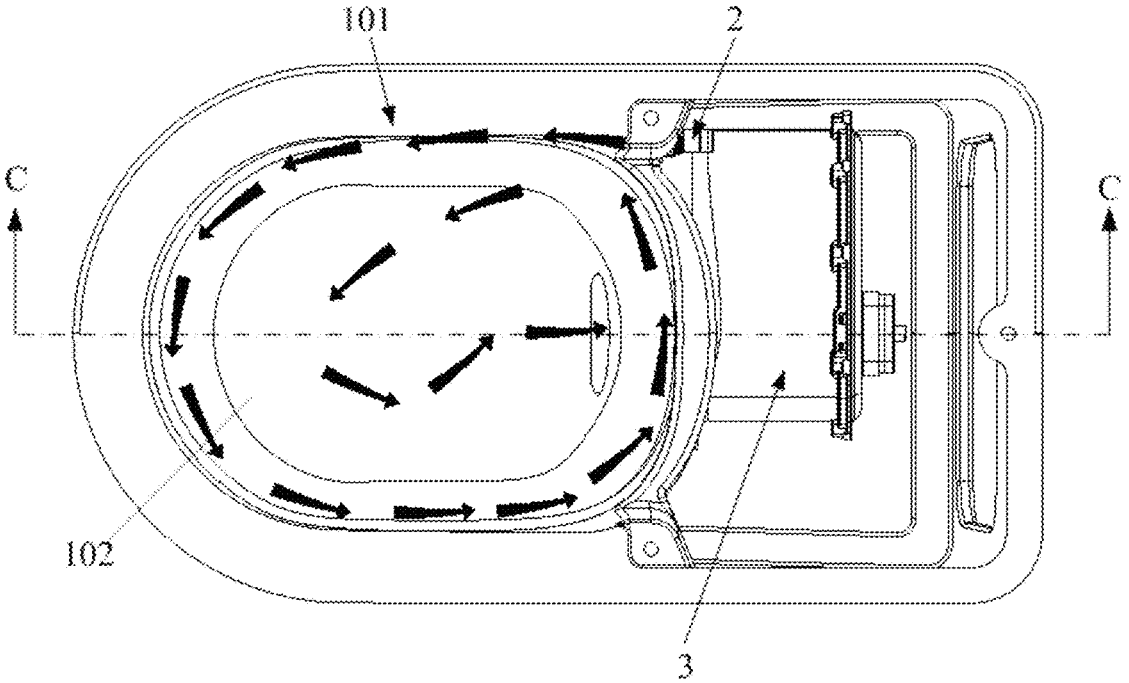
FIG. 4 is a top schematic view of a toilet according to some schematic embodiments of the present application.

In some exemplary embodiments, as shown in FIGS. 1 to 5, a rimmed area 101B may be provided at the rear side of the bowl cavity 10. The brush ring water outlet 105 may be provided in the rimmed area 101B, such an arrangement may achieve a concealed arrangement of the brush ring water outlet 105, as shown in FIG. 4. The brush ring water outlet 105 may be provided as a circular hole or the like, as shown in FIG. 2. As shown in FIG. 4, the brush ring assembly 2 may be mounted on the toilet seat body 1 through the brush ring water outlet 105. After the brush ring assembly 2 is installed in place, the outer contour of the brush ring assembly 2 may be provided so that the outer contour does not exceed an edge of the rimmed area 101B, and a concealed arrangement of the brush ring assembly 2 may be realized. The brush ring liquid conveyed through the brush ring assembly 2 may be shielded to a certain extent by the rim feature of the rimmed area 101B, so as not to increase the workload of the cleaning operation due to the splash of the brush ring liquid, and so as not to reduce the user experience.

In some exemplary embodiments, as shown in FIGS. 1 to 4, a size of the rimless area 101A of the water inlet part 101 in the circumferential direction of the water inlet part 101 may be designed to be greater than a size of the rimmed area 101B in the circumferential direction of the water inlet part 101, that is, the proportion of the rimmed area 101B to the circumferential size of the whole water inlet part 101 may be reduced as much as possible to obtain a larger rimless area 101A. This arrangement, on one hand, may reduce the structural complexity of the toilet seat body 1 and reduce the manufacturing difficulty, and on the other hand, may improve the cleaning convenience of the toilet seat body 1. The rimless area 101A is easier to clean than the rimmed area 101B, which may reduce the amount of cleaning operation as a whole.

In some exemplary embodiments, as shown in FIGS. 1 to 5, the toilet seat body 1 further includes an installation cavity 11. As shown in FIG. 1, the bowl cavity 10 is closer to the front side of the toilet seat body 1 than the installation cavity 11, and the bowl cavity 10 and the installation cavity 11 may be arranged side by side in the front and rear direction. The installation cavity 11 may be provided as a cuboid or the like as shown in FIG. 1. The installation cavity 11 is mainly used to provide an installation space for functional components of the toilet. The functional components are such as a water pump (not shown in the figures) or a sewage discharge box assembly 3, for example, as shown in FIG. 6. As shown in FIG. 1, the sewage discharge box assembly 3 includes a sewage discharge pipe 30, a connection element 31, and the like. The connection element 31 is used for connecting the sewage discharge pipe 30 and the sewage discharge part 103. The connection element 31 includes mounting bolts, sealing elements, and the like. The sewage discharge pipe 30 is communicated with the sewage discharge port 104 provided in the sewage discharge part 103, so that dirt is transported from the bowl cavity 10 into the sewage discharge pipe 30, and the dirt is transported to a shifter or a sewer outlet provided on the ground by the relative rotation of the sewage discharge pipe 30 relative to the sewage discharge port 104. The toilet further includes a driving device (not shown in the figures), an output end of the driving device is connected to the sewage discharge pipe 30, and the driving device may drive the sewage discharge pipe 30 to rotate back and forth relative to the sewage discharge port 104.

As shown in FIGS. 1 and 2, the flow guide part 102 is not provided with a spray port, that is, an area of the flow guide part 102 opposite to the sewage discharge port 104 is provided as a closed wall surface. This arrangement facilitates the washing of the brush ring liquid on the wall surface, improves the cleaning convenience, and avoids the accumulation of dirt. In terms of the overall structure of the toilet, the sewage discharge mode is changed as the sewage discharge box assembly 3 is provided, and the sewage discharge is realized by the rotation of the sewage discharge pipe 30 relative to the bowl cavity 10. Therefore, there is no need to provide a spray port, and the flushing noise may be effectively reduced.

Figure 5:
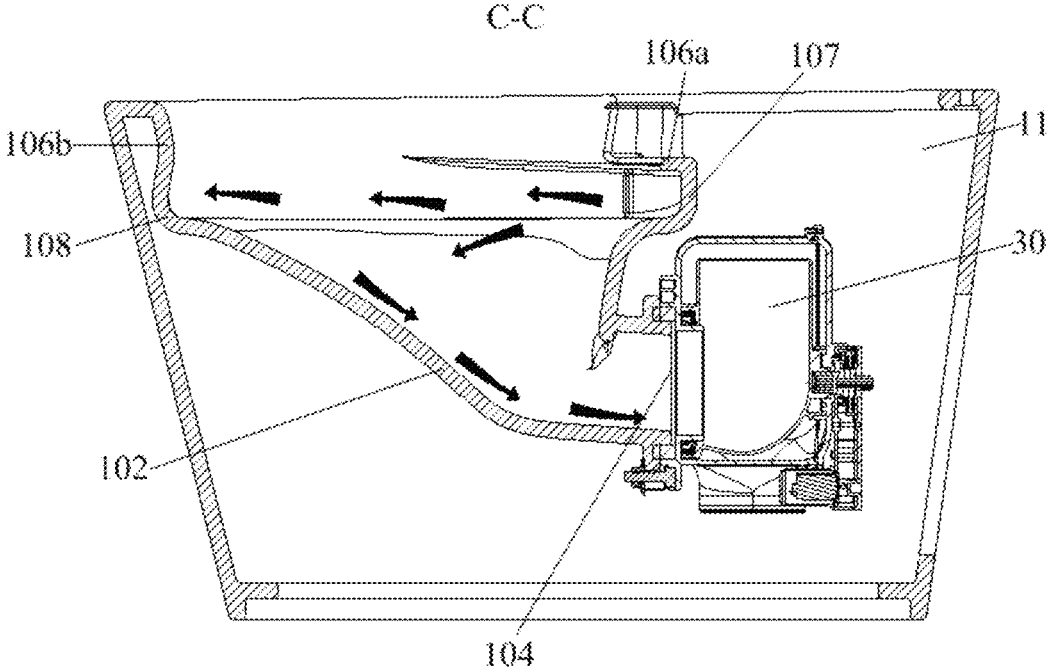
FIG. 5 is a sectional schematic view at identification C-C in FIG. 4.
Figure 6:
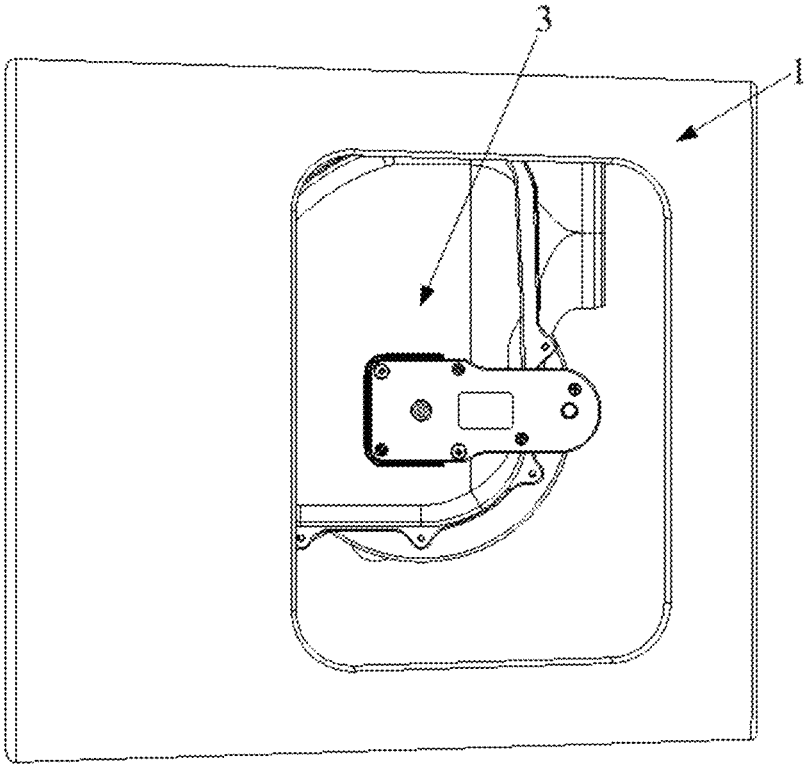
FIG. 6 is a side schematic view of a toilet according to some schematic embodiments of the present application.

In some exemplary embodiments, as shown in FIGS. 1 and 5, an area of the flow guide part 102 opposite to the sewage discharge port 104 may be provided as a sloped surface smoothly connected to the sewage discharge part 103. When the toilet is flushed, the sloped surface facilitates the movement of the dirt from the flow guide part 102 toward the sewage discharge part 103, thereby effectively avoiding an attachment of dirt, reducing the workload of the cleaning operation, and improving the cleaning operation efficiency.

In some exemplary embodiments, as shown in FIGS. 1 to 3, the water inlet part 101 includes an extension part 106 and a flow channel part. The extension part 106 is close to an upper part of the bowl cavity 10 compared to the flow channel part, and the extension part 106 is connected to, or may be smoothly connected to, the upper end of the flow channel part. The flow channel part includes a recess part 107 and a smooth part 108. The brush ring water outlet 105 may be provided at the recess part 107. The recess part 107 and the smooth part 108 are connected in the circumferential direction of the bowl cavity 10. The recess part 107 and the smooth part 108 together form a portion of the brush ring water channel, or form the whole brush ring water channel. The brush ring liquid is outputted via the brush ring assembly 2, flows out of the recess part 107, and is guided through the smooth part 108, so as to realize the cleaning operation of the bowl cavity 10. As shown in FIG. 5, the smooth part 108 may be provided as a curved surface sunken outward in the radial direction of the bowl cavity 10, and the curved surface may be a circular arc surface or the like. The curved surface feature of the smooth part 108 may be used to better guide the brush ring liquid, and the splashing of the brush ring liquid may be effectively avoided, thereby reducing the cleaning workload of the toilet.

As shown in FIG. 2, the extension part 106 includes three portions, namely a first extension region 106*a*, a second extension region 106*b*, and a notch 106*c*, respectively. In the circumferential direction of the bowl cavity 10, the first extension region 106*a*, the second extension region 106*b*, and the notch 106*c* may be sequentially connected. The notch 106*c* may be located at the rear of the entire extension part 106, i.e., provided adjacent to the installation cavity 11. The notch 106*c* may provide an avoidance space for the installation or movement of other components of the toilet, such as the seat ring of the toilet, and the like.

The first extension region 106*a* is located directly above the recess part 107, and the first extension region 106*a* and the recess part 107 enclose a groove, as shown in FIG. 5. The groove is used to form the rimmed area 101B. The second extension region 106*b* is located directly above the smooth part 108 and is smoothly connected to the smooth part 108. The second extension region 106*b* and the smooth part 108 jointly form the rimless area 101A, as shown in FIG. 2.

In some exemplary embodiments, as shown in FIG. 2, the flow channel part as a whole may have an annular structure, for example, a torus, or a semi-torus, or the like. Alternatively, the flow channel part is spiral-shaped in an upper and lower direction of the toilet, or the like.

As shown in FIGS. 1 and 3, the recess part 107 includes a first recess 107*a* and a second recess 107*b* connected in the circumferential direction of the bowl cavity 10. The first recess 107*a* is located obliquely below the notch 106*c*, and the second recess 107*b* is located directly below the notch 106*c*. One end of the first recess 107*a* connected to the second recess 107*b* is provided with a vertical step surface, and the brush ring water outlet 105 is provided on the step surface. One end of the second recess 107*b* distanced from the first recess 107*a* is smoothly connected to the smooth part 108 in the circumferential direction of the bowl cavity 10. When the toilet is flushed, the brush ring liquid outputted through the brush ring assembly 2 can flow downwardly along the inner wall of the bowl cavity 10 from an area close to the second recess 107*b* through the guidance of the smooth part 108, and may present a turbo-shaped water flow, which may effectively avoid cleaning dead spots and improve cleaning quality.

In some exemplary embodiments, as shown in FIGS. 4 and 5, a depth of the groove enclosed by the first extension region 106*a* and the recess part 107 in a water flow direction of the brush ring water outlet 105, that is, a direction indicated by an arrow line in the figures, may be designed to be gradually reduced in a radial direction of the bowl cavity 10, so that at least one end of the recess part 107 and the smooth part 108 are smoothly connected in the circumferential direction of the bowl cavity 10, so as to improve the flowability of the brush ring liquid, and to create a certain gathering effect on the brush ring liquid, and to avoid splashing of the brush ring liquid.

In the description of the present application, it needs to be understood that the orientations or position relationships indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" and the like are based on those shown in the drawings, which are only for convenience of describing the present application and simplifying the description and are not intended to indicate or imply that the referred device or element must have a particular orientation, or is constructed and operated in a particular orientation and therefore cannot be construed as limiting on the present application.

Furthermore, the terms "first", "second" are only used for descriptive purposes and cannot be understood as indicating or implying relative importance or implying the quantity of technical features indicated. Thus, features defined with "first" or "second" may explicitly or implicitly include at least one of the features. In the description of the present application, "multiple/a plurality of" means at least two, e.g. two, three and the like, unless explicitly defined otherwise.

In the present application, unless otherwise expressly specified and qualified, terms "mount", "couple", "connect", "fix" and the like shall be understood in a broad sense. For example, they may be fixed connection, detachable connection or integrated connection; they may be mechanical connection or electrical connection; they may be direct connection or indirect connection through an intermediate medium, or may be an internal communication between two elements or an interactive relationship between two elements, unless otherwise expressly defined. For those of ordinary skills in the art, meanings of the above terms in the present application can be understood according to situations.

In the present application, the first feature being "above" or "below" the second feature may be a direct contact between the first and second features, or an indirect contact between the first and second features via an intermediary, unless otherwise expressly specified and defined. Moreover, the first feature being "on", "above" and "over" the second feature may be the first feature being directly above or obliquely above the second feature, or simply indicate that the level of the first feature is higher than that of the second feature. The first feature being "under", "below" and "underneath" the second feature may mean that the first feature is directly below or obliquely below the second feature, or simply mean that the level of the first feature is less than that of the second feature.

In the description of this specification, descriptions with reference to terms "one embodiment", "some embodiments", "example", "specific example" or "some examples" and the like mean that features, structures, materials, or characteristics described in conjunction with the embodiment or example are included in at least one embodiment or example of the present application. In this specification, the schematic illustration of the above terms does not need to be directed to the same embodiments or examples. Further, the features, structures, materials, or characteristics described may be combined in a suitable manner in any one or more embodiments or examples. Further, those skilled in the art may incorporate and combine different embodiments or examples and features of different embodiments or examples described in this specification if there is no conflict.

Although the embodiments of the present application have been illustrated and described above, it may be understood that the above-described embodiments are exemplary and cannot be construed as a restriction on the present application. Changes, modifications, substitutions and variations may be made to the above-described embodiments by those of ordinary skills in the art within the scope of the present application.

The invention claimed is:

1. A toilet seat body, provided with a bowl cavity; wherein the bowl cavity comprises a water inlet part, a flow guide part, and a sewage discharge part connected sequentially; the water inlet part is provided with a brush ring water outlet and the sewage discharge part is provided with a sewage discharge port;

the water inlet part is located at a top part of the bowl cavity, the water inlet part is at least partially configured as a rimless area, and the rimless area is smoothly connected with the flow guide part;

wherein a portion of the water inlet part is configured as a rimmed area, and the brush ring water outlet is provided in the rimmed area;

wherein the water inlet part comprises:

a flow channel part comprising a recess part and a smooth part, wherein the brush ring water outlet is provided in the recess part, the recess part and the smooth part are connected in a circumferential direction of the bowl cavity, and form at least a part of a brush ring water channel communicated with the brush ring water outlet; and an extension part connected to an upper end of the flow channel part;

wherein a portion of the extension part located directly above the recess part and the recess part enclose a groove, and said portion and the recess part jointly form the rimmed area; a portion of the extension part located directly above the smooth part is smoothly connected with the smooth part, and said portion and the smooth part jointly form the rimless area;

wherein the flow channel part is of an annular structure, and a rear portion of the extension part is provided with a notch;

the recess part comprises a first recess and a second recess connected in the circumferential direction of the bowl cavity, the first recess is located obliquely below the notch, and the second recess is located directly below the notch;

one end of the first recess connected with the second recess is provided with a vertical step surface, and the brush ring water outlet is provided on the step surface;

one end of the second recess away from the first recess is smoothly connected with the smooth part along the circumferential direction of the bowl cavity.

2. The toilet seat body according to claim 1, wherein in a water flow direction of the brush ring water outlet, a depth of the groove in a radial direction of the bowl cavity is gradually reduced, so that at least one end of the recess part is smoothly connected with the smooth part in the circumferential direction of the bowl cavity.

3. The toilet seat body according to claim 1, wherein the smooth part is provided as a curved surface sunken outward along a radial direction of the bowl cavity.

4. The toilet seat body according to claim 1, wherein a size of the rimless area in a circumferential direction of the water inlet part is greater than a size of the rimmed area in the circumferential direction of the water inlet part.

5. The toilet seat body according to claim 1, wherein the toilet seat body is further provided with an installation cavity, the installation cavity and the bowl cavity are arranged side by side; the installation cavity is provided with a space for installing a sewage discharge box assembly, the sewage discharge box assembly comprises a sewage discharge pipe, the sewage discharge pipe is provided to communicate with the sewage discharge port and is capable of rotating relative to the sewage discharge port;

wherein an area of the flow guide part opposite to the sewage discharge port is provided as a closed wall surface.

6. The toilet seat body according to claim 5, wherein the area of the flow guide part opposite to the sewage discharge port is provided as a sloped surface smoothly connected with the sewage discharge part.

7. A toilet, comprising the toilet seat body according to claim 1 and a brush ring assembly installed to the brush ring water outlet.

8. The toilet seat body according to claim 2, wherein the smooth part is provided as a curved surface sunken outward along a radial direction of the bowl cavity.

9. The toilet seat body according to claim 5, wherein the smooth part is provided as a curved surface sunken outward along a radial direction of the bowl cavity.

10. The toilet seat body according to claim 3, wherein a size of the rimless area in a circumferential direction of the water inlet part is greater than a size of the rimmed area in the circumferential direction of the water inlet part.

11. The toilet seat body according to claim 2, wherein a size of the rimless area in a circumferential direction of the water inlet part is greater than a size of the rimmed area in the circumferential direction of the water inlet part.

12. The toilet seat body according to claim 5, wherein a size of the rimless area in a circumferential direction of the water inlet part is greater than a size of the rimmed area in the circumferential direction of the water inlet part.

13. The toilet seat body according to claim 2, wherein the toilet seat body is further provided with an installation cavity, the installation cavity and the bowl cavity are arranged side by side; the installation cavity is provided with a space for installing a sewage discharge box assembly, the sewage discharge box assembly comprises a sewage discharge pipe, the sewage discharge pipe is provided to communicate with the sewage discharge port and is capable of rotating relative to the sewage discharge port;

wherein an area of the flow guide part opposite to the sewage discharge port is provided as a closed wall surface.

14. The toilet seat body according to claim 13, wherein the area of the flow guide part opposite to the sewage discharge port is provided as a sloped surface smoothly connected with the sewage discharge part.

* * * * *